US005394700A

United States Patent [19]

Steele

[11] Patent Number: 5,394,700

[45] Date of Patent: Mar. 7, 1995

[54] STIRLING ENGINE WITH GANGED CYLINDERS AND COUNTER ROTATIONAL OPERATING CAPABILITY

[76] Inventor: Ronald J. Steele, 4612 Freemont St., Boise, Id. 83706

[21] Appl. No.: 135,081

[22] Filed: Oct. 12, 1993

[51] Int. Cl.[6] ..... F01B 29/10

[52] U.S. Cl. ..... 60/525; 60/517

[58] Field of Search ..... 60/516, 517, 522, 525, 60/526

[56] References Cited

U.S. PATENT DOCUMENTS

| | | | |
|---|---|---|---|
| 1,614,962 | 1/1927 | Koenig | 60/525 |
| 1,879,563 | 9/1932 | Smith | 60/525 |
| 4,026,114 | 5/1977 | Belaire | 60/525 |
| 4,395,881 | 8/1983 | Fraser | 60/517 |
| 4,408,456 | 10/1983 | Rauch | 60/518 |
| 4,559,779 | 12/1985 | Brown | 60/517 |
| 4,638,633 | 1/1987 | Otters | 60/517 |
| 4,856,280 | 8/1989 | Chagnot | 60/522 |

*Primary Examiner*—Ira S. Lazarus
*Assistant Examiner*—L. Heyman
*Attorney, Agent, or Firm*—Frank J. Dykas; Craig M. Korfanta

[57] ABSTRACT

A Stirling cycle engine having its cylinders ganged together by connecting through a cross connect passage and valve the cold variable volume chamber of one cylinder with the compression chamber of a cylinder in which the displacer piston and the power piston are ninety degrees (90°) out-of-phase with the pistons in the first cylinder.

The displacer piston and power piston in each cylinder are connected by a sealed piston rod so that the two pistons move in unison. Each cylinder's power piston is connected by means of a connecting rod to a means for converting the reciprocating motion of the power piston into rotational motion. Each cross connect passage is provided with a valve which allows a working fluid to pass from the cold variable volume chamber of one cylinder to the compression chamber of any cylinder which is ninety degrees (90°) out-of-phase with the displacer piston of the first cylinder. This valving feature allows the engine to be reversed and throttled. Each displacer cylinder is provided with an annular groove regenerator which is adapted to accept a thermally conductive material for conducting heat to and from the working fluid thereby operating in the capacity of a regenerator. Finally, in one embodiment, the bulkhead which separates the displacer cylinder from the power cylinder is removable. When the bulkhead is removed, reoriented and reinstalled, the engine operates in an opposite direction of rotation.

15 Claims, 8 Drawing Sheets

STIRLING ENGINE WITH GANGED CYLINDERS AND COUNTER ROTATIONAL OPERATING CAPABILITY

BACKGROUND OF THE INVENTION

1. Technical Field

The present invention relates to a Stirling cycle engine, and more particularly to a Stirling cycle engine having its cylinders ganged together by connecting the cold variable volume chamber of one cylinder to a compression chamber of an adjacent cylinder which is ninety degrees out-of-phase with the cylinder housing the connected cold variable volume chamber.

2. Background

Stirling cycle engines, in existence since the early 19th century, have not come into widespread use for a variety of reasons. A primary problem has been the Stirling cycle engine's greater number of piston rods and crank shaft throws has slowed the utilization of this engine in automobiles, for example, due to increased complexity, engine size and cost. Also, providing a seal between the high pressures developed in the displacer cylinder portion and the lower pressures in the crankcase has created difficulties.

Accordingly, among the objects of the present invention is to minimize the number of connecting rods, and hence crankcase penetrations, thereby minimizing sealing problems.

Another objective is to minimize crank shaft throws, and hence engine complexity and expense, by minimizing the number of connecting rods.

A third and related object is to permit the Stirling cycle engine to be adapted for use in a standard engine block.

An additional objective is to provide a means by which the engine may be operated in either a clockwise or a counter clockwise rotation.

A final objective of the present invention is to provide a means for throttling the engine speed by regulating the flow of the working fluid between the cold variable volume chamber of one cylinder and the cross connected compression chamber.

DISCLOSURE OF INVENTION

According to the present invention, these and other objects can be attained by a configuration whereby a given cylinder's displacer piston driver rod is connected to, and driven by the same cylinder's power piston, rather than by the crankshaft, as in the conventional Stirling cycle engine. A displacer piston and the power piston so connected move together in synchronization. Only one connecting rod and one crankcase penetration per cylinder, as in the typical internal combustion engine is thereby needed.

In the conventional Stirling cycle engine, the displacer piston and power pistons must be ninety degrees (90°) out-of-phase, necessitating separate displacer piston and power piston rods connecting to crankshaft arms aligned on the crankshaft ninety (90°) degrees offset.

The present invention achieves its single rod per cylinder configuration by means of passages connecting each cylinder's cold variable volume displacement chamber with an adjacent cylinder's compression chamber. The cylinders are ganged together in a manner whereby a given cylinder's pistons lead the cross connected cylinder's pistons by ninety (90°) degrees. In this way the cross connected cylinders' displacer piston is in Stirling cycle synchronization with the power piston in either of the two adjacent cylinders depending upon the desired rotation of the crankshaft.

Because only one connecting rod per cylinder is utilized, only one crank shaft throw per cylinder is needed. Therefore, a standard engine block may used to house the invention.

BEST MODE FOR CARRYING OUT INVENTION

Figure 1:
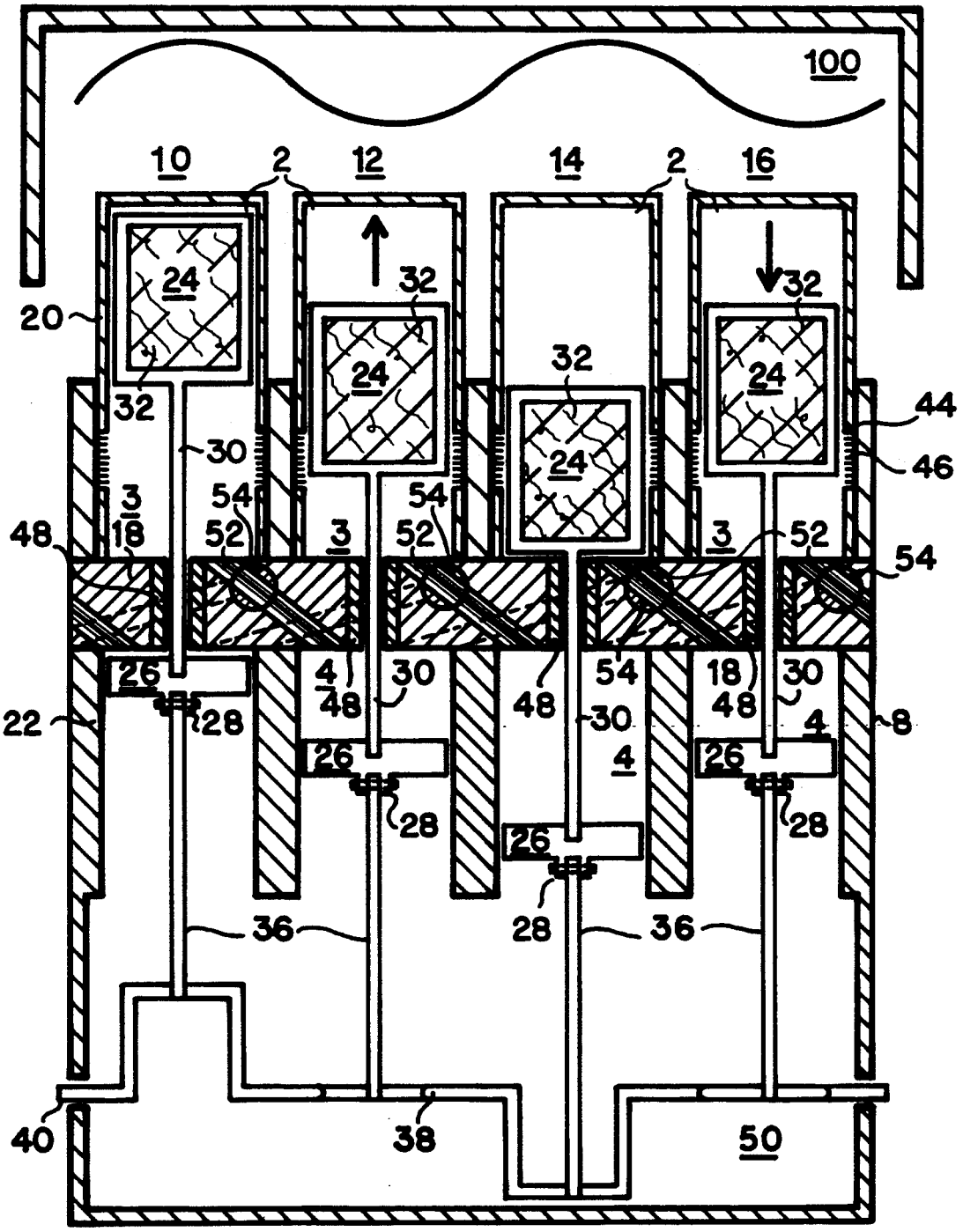
FIG. 1 shows a sectional view of a horizontal in-line configuration for a Stirling cycle engine in accordance with the preferred embodiment of the present invention.

Referring first to FIGS. 1 through 4, there is shown an in-line four cylinder Stirling cycle engine including an engine block 8 having bored therein four identical cylinders 10, 12, 14 and 16 in an in-line configuration, each cylinder 10, 12, 14 and 16 being divided into a displacer cylinder portion 20 and power cylinder portion 22. Each displacer piston 24 separates its displacer cylinder portion 20 into a hot variable volume chamber 2 and a cold variable chamber 3. The lower end of each power cylinder portion 22 is open to crankcase 50.

Heat from external heat source 100 is conducted to a working fluid contained in hot variable volume chamber 2. Heat is conducted from the working fluid contained in cold variable volume chamber 3 by means of an annular groove regenerator 44. The annular groove regenerator utilizes a thermally conductive material 46 as a means for conducting heat to and from the working fluid thereby operating in the capacity of a regenerator. Each cylinder 10, 12, 14 and 16 has a loose-fitting displacer piston 24 connected to a power piston 26 by means of a piston rod 30 which is carried through a bulkhead 18 by a seal/bearing assembly 48 for concurrent reciprocation of the displacer piston 24 and its so connected power piston 26. Each power piston 26 is pivotally connected to a connecting rod 36 by means of a wrist pin assembly 28. Each connecting rod 36 is connected to crankshaft 40 by means of conventional journaled piston rod bearings (not shown). Crankshaft 40 converts the reciprocating motion of power pistons 26 into circular motion of crankshaft 40.

A crank arm 38 for each cylinder 10, 12, 14 and 16 is located on crankshaft 40 such that the crank arm 38 for any given cylinder 10, 12, 14 or 16 is configured ninety degrees (90°) out-of-phase in the crankshaft rotation cycle from the crank arm of the preceding cylinder and the subsequent cylinder in out-of-phase rotation. Referring to FIG. 1, for example, when cylinder 10's power piston 26 is at top dead center, cylinder 12's power piston 26 is at middle dead center going up, ninety degrees (90°) out-of-phase in crankshaft 40 rotation with power piston 26 of cylinder 10. Similarly, power piston 26 of cylinder 14 is at bottom dead center, one-hundred and eighty degrees (180°) out-of-phase in crankshaft 40 rotation with power piston 26 of cylinder 10. Power piston 26 of cylinder 16 is at middle dead center going down, ninety degrees (90°) out-of-phase in crankshaft 40 rotation with power piston 26 of cylinder 10.

Cylinders 10, 12, 14 and 16 are joined together sequentially in the following manner: cylinder cross connect passage 52 operatively connects the cold variable volume chamber 3 in each cylinder 10, 12, 14 and 16 through valve 54 to the compression chamber 4 in the cylinder which is ninety (90°) degrees out-of-phase in crankshaft rotation, thereby enabling a given cylinder's power piston 26 to be driven by the thermal expansion and contraction of the working fluid contained in displacement cylinder 24 of the cylinder which is adjacent in out-of-phase rotation by ninety degrees (90°).

Each displacer piston 24 is formed as a hollow cylinder closed at either end and packed with high temperature insulation 32 which operates to reduce thermal conductance through displacer piston 24.

Though the preferred embodiment consists of four cylinders 10, 12, 14 and 16, configurations of more than four cylinders are achievable whereby any one cylinder's cold variable volume chamber 3 is cross connected to the compression chamber 4 in a cylinder whose power piston is ninety degrees (90°) out-of-phase rotation.

Referring to FIG. 1, a working fluid, usually air, is 10 contained within displacer cylinder portion 20 of cylinder 10, cylinder cross connect passage 52, valve 54 and compression chamber 4 of cylinder 12. The working fluid moves by operation of thermal expansion and contraction between the displacer cylinder portion 20 of cylinder 10 and compression chamber 4 of cylinder 12 via cylinder cross connect passage 52 and valve 54.

Similarly, a working fluid is contained within displacer cylinder portion 20 of cylinder 12, cylinder cross connect passage 52, valve 54 and compression chamber 4 of cylinder 14 and moves by operation of heat and pressure between the displacer cylinder portion 20 of cylinder 12 and the compression chamber 4 of cylinder 14 via cylinder cross connect passage 52 and valve 54.

Similarly, a working fluid is contained within displacer cylinder portion 20 of cylinder 14, cylinder cross connect passage 52, valve 54 and compression chamber 4 of cylinder 16 and moves by operation of heat and pressure between the displacer cylinder portion 20 of cylinder 14 and the compression chamber 4 of cylinder 16 via cylinder cross connect passage 52 and valve 54.

Finally, a working fluid is contained within displacer cylinder portion 20 of cylinder 16, cylinder cross connect passage 52, valve 54 and compression chamber 4 of cylinder 10 and moves by operation of heat and pressure between the displacer cylinder portion 20 of cylinder 16 and the compression chamber 4 of cylinder 10 via cylinder cross connect passage 52 and valve 54.

In the preferred embodiment, cross connect passage 52 intersects valve 54 which may be switched so that the working fluid may be channeled to either of the adjacent cylinders. In this manner, the engine may be operated to rotate in either direction. Valve 54 allows the working fluid to be directed via the cylinder cross connect passage 52 to either of the adjacent cylinders, so long as power piston 26 of the adjacent cylinder is ninety (90°) degrees out-of-phase with the displacement piston 24 of the cylinder so connected. For example, referring to FIG. 1, displacer cylinder portion 20 of cylinder 10 may be connected by means of operation of valve 54 to either compression chamber 4 of cylinder 12 or compression chamber 4 of cylinder 16.

In addition, valve 54 may be operated as a throttle regulating the flow and pressure of the working fluid between displacer cylinder portion 20 and compression chamber 4 of an adjacent cylinder thereby regulating the speed of the engine.

Referring to FIG. 1, cylinder 10 and cylinder 12, working fluid in cold variable volume chamber 3 of cylinder 10 is cooled by engine block 8. Additionally, heat is conducted from the working fluid by operation of annular groove regenerator 44 packed thermally conductive material 46 which operates in the capacity of a regenerator.

As the working fluid cools, a decrease in pressure occurs within cold variable volume chamber 3 of cylinder 10 and compression chamber 4 of cylinder 12 drawing displacement piston 24 of cylinder 10 downwards toward bulkhead 18 driving the power piston of cylinder 12 upwards towards bulkhead 18 as a result of the decreasing pressure and associated thermal contraction, imparting a rotational force to crankshaft 40 through connecting rod 36 and crank arm 38 of cylinder 12, displacing the working fluid in cold variable volume chamber 3 of cylinder 10 and compression chamber 4 of cylinder 12 upwards past displacer piston 24 of cylinder 10 into hot variable volume chamber 2 of cylinder 10.

As the working fluid is displaced it will flow upward around displacer piston 24 of cylinder 10, along and past annular groove regenerator 44 packed with thermally conductive material 46 which together function in the capacity of a regenerator, conducting heat from thermally conductive material 46 into the working fluid, into hot variable volume chamber 2 of cylinder 10. In hot variable volume chamber 2 of cylinder 10, the working fluid will once again be heated by the external heat source 100.

During this same phase shown in FIG. 1., working fluid contained in hot variable volume chamber 2 of cylinder 14 is heated by the external heat source 100. The heated working fluid expands, moving past displacer piston 24 of cylinder 14 and downward through cylinder cross connect passage 52 and valve 54 to exert a driving force against power piston 26 of cylinder 16 which is transferred via connecting rod 36 to crankshaft 40.

Thus, FIG. 1 depicts both a thermal contraction cycle (cylinders 10 and 12) and a thermal expansion cycle (cylinders 14 and 16) of the Stirling engine cycle.

Figure 2:
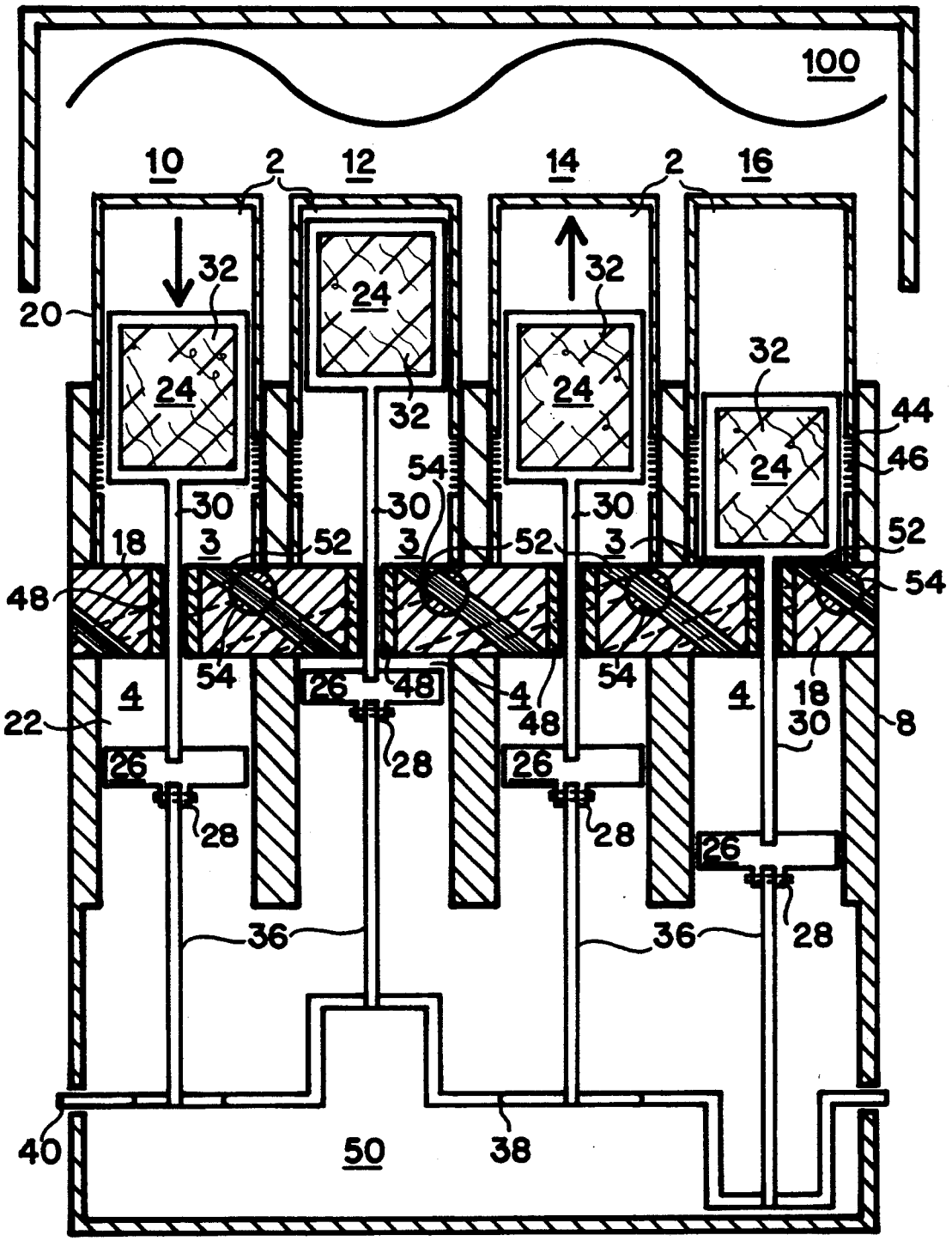
FIG. 2 shows the sectional view of the horizontal in-line cylinder Stirling cycle engine of FIG. 1 showing the crankshaft and pistons advanced ninety (90°) degrees.

FIG. 2 shows cylinder 12 and cylinder 14 in a thermal contraction cycle while cylinder 16 and cylinder 10 pass through the thermal expansion cycle.

Figure 3:
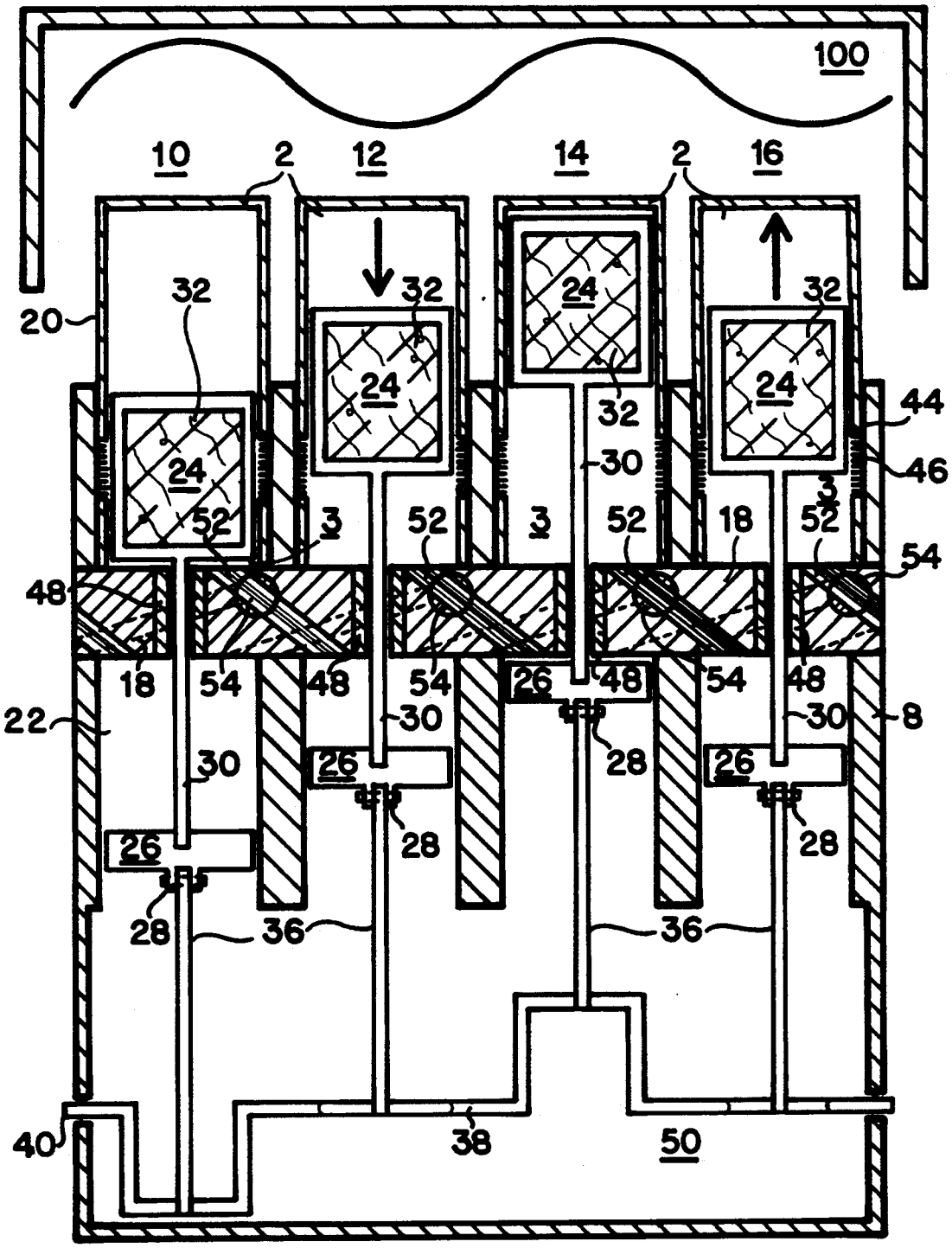
FIG. 3 shows the sectional view of the horizontal in-line cylinder Stirling cycle engine of FIG. 2 showing the crankshaft and pistons advanced ninety (90°) degrees.

FIG. 3 shows cylinder 14 and cylinder 16 in a thermal contraction cycle without cylinder 10 and cylinder 12 pass through the thermal expansion cycle.

Figure 4:
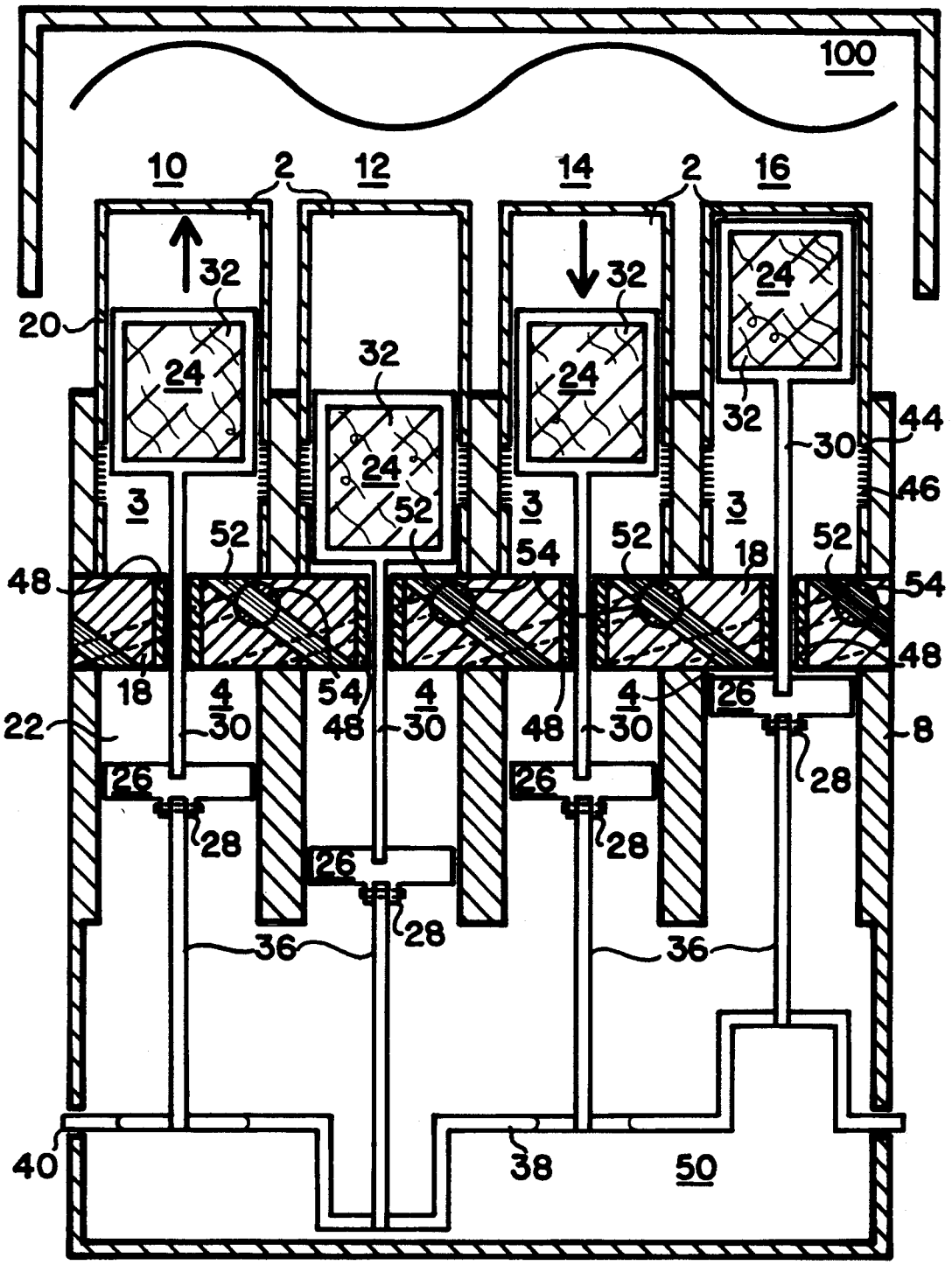
FIG. 4 shows the sectional view of the horizontal in-line cylinder Stirling cycle engine of FIG. 3 showing the crankshaft and pistons advanced ninety (90°) degrees.

FIG. 4 shows cylinder 16 and cylinder 10 in a thermal contraction cycle, while cylinder 12 and cylinder 14 pass through the thermal expansion cycle.

FIGS. 5, 6, 7 and 8 show alternative embodiments of the invention whereby four cylinders 10, 12, 14 and 16 of a Stirling cycle engine are arranged in a square formation, within a circular block 70 thereby providing a physically compact engine.

Figure 5:
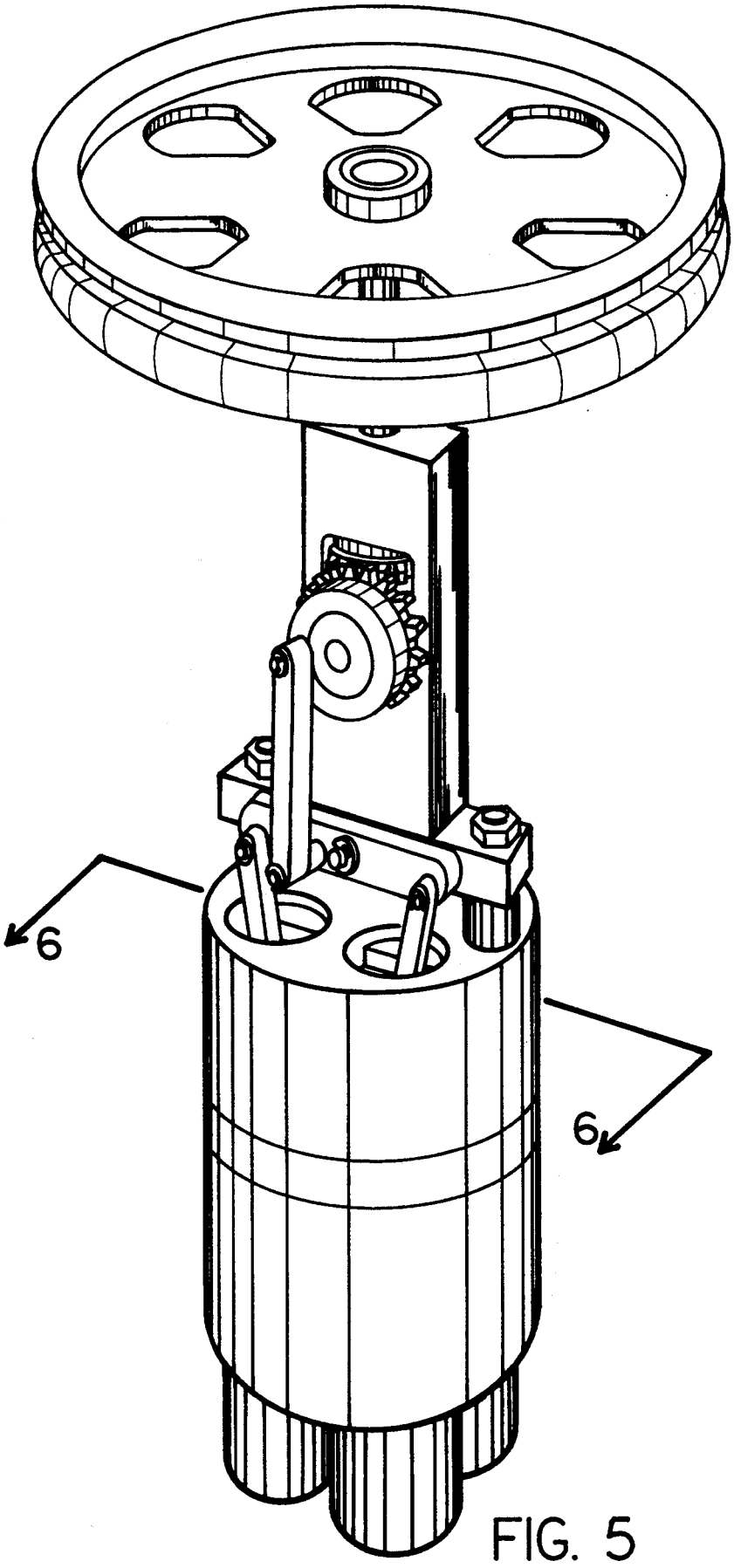
FIG. 5 shows an alternative embodiment of the present invention comprising a circular configuration for a Stirling cycle engine with output of rotational force provided by means of a bevel gear drive.
Figure 6:
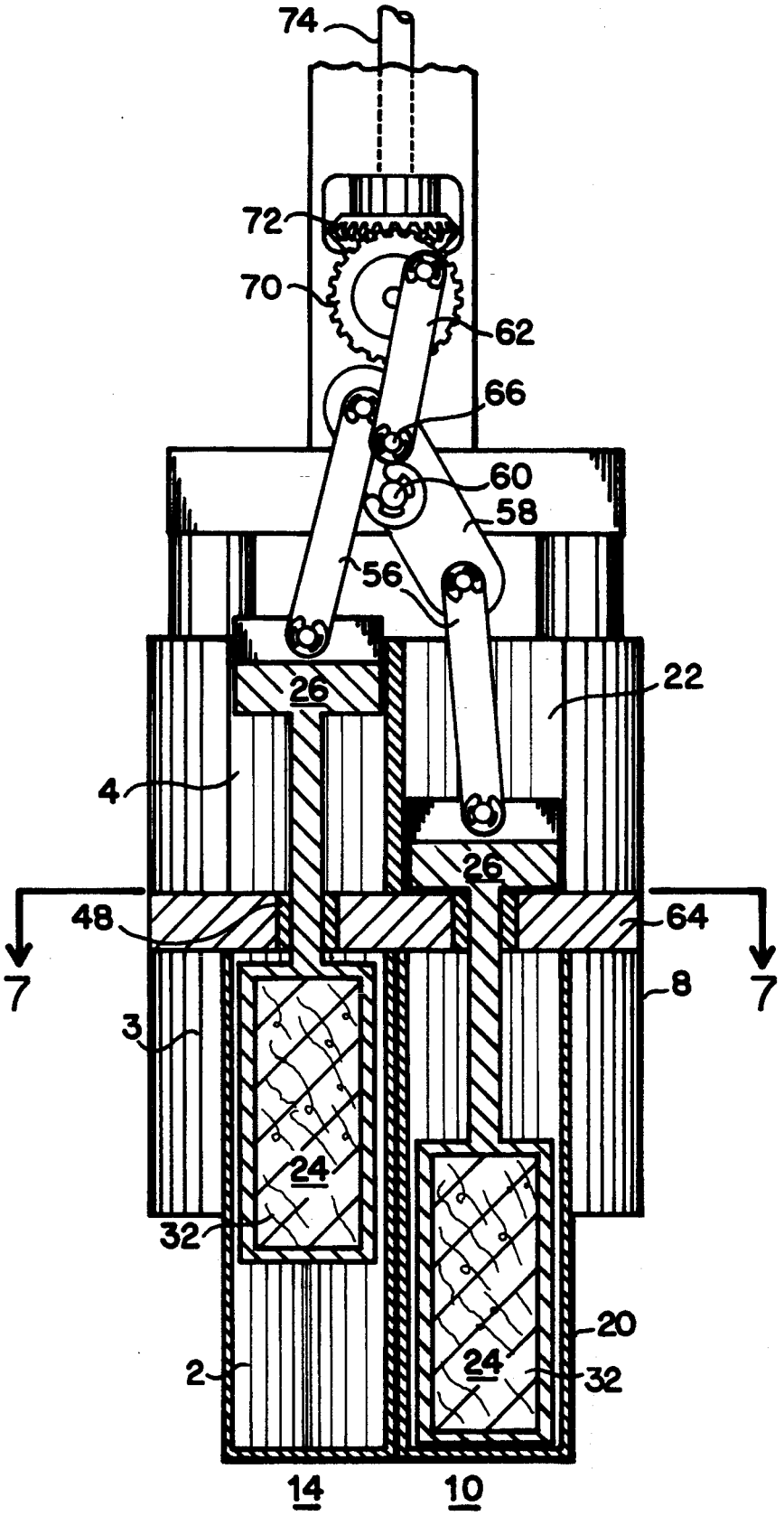
FIG. 6 is a section of FIG. 5 showing a vertical cutaway of cylinder 10 and cylinder 14.
Figure 7:
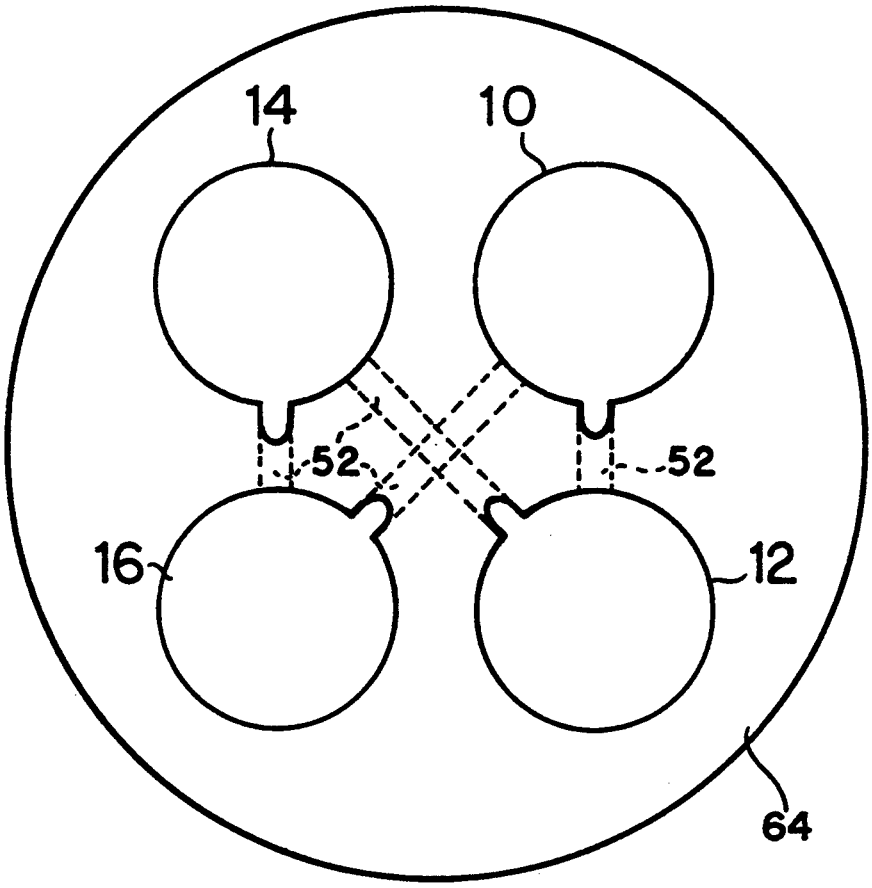
FIG. 7 shows a section of FIG. 6.

Referring to FIGS. 5, 6 and 7 connecting rod 56 of each cylinder 10, 12, 14 and 16 is pivotally connected for reciprocation therewith to power piston 26 on one end and on the other end to rocker arm 58. Rocker arm 58 is pivotally connected at pivot point 60 allowing rocker arm 58 to follow the motion of connecting rods 56 depending upon the location of the piston within any given cylinder 10, 12, 14 and 16. Throw arm 62 is pivotally connected at one end to rocker arm 58 at a point 66 which is eccentric to pivot point 60 of rocker arm 58. The other end of throw arm 62 is pivotally connected to a crank bevel gear 70 at the crank bevel gear's periphery. Drive shaft bevel gear 72 forms one end of drive shaft 74. Drive shaft bevel gear 72 is orthogonally aligned in contact with crank bevel gear 70. Crank bevel gear 70 transfers a rotational force to driveshaft 74 through driveshaft bevel gear 72, which is fixedly attached to drive shaft 74 and maintains orthogonal contact with crank bevel gear 70.

Output from cylinders 12 and 16 are similarly converted to rotational force via connecting rods 56, rocker arm 58, throw arm 62, and crank bevel gear 70. This alternative configuration thereby allows any given cylinder to operate ninety degrees (90°) out-of-phase with the pistons driving the opposite rocker arm assembly. In this embodiment, connection of cylinders 10, 12, 14 and 16 via cross connect passage 52 and operation of the engine is similar to that described in the preferred embodiment above.

Referring to FIG. 7, a removable bulkhead 64 having a top side and a bottom side. Cross connect passages 52 pass diagonally through the cross section of removable bulkhead 64 from the cold variable volume chamber 3 in each cylinder 10, 12, 14 and 16 to the compression chamber 4 of an adjacent cylinder which is in ninety (90°) degrees out-of-phase relation to the cross connected cylinder. Removable bulkhead 64 serves as a means for reversing engine direction. When removable bulkhead 64 is installed in the engine with the top side of removable bulkhead 64 oriented towards the power cylinder portion 22 of the engine, the engine operates in one direction of rotation. When removable bulkhead 64 is installed in the engine with the top side of removable bulkhead 64 oriented towards the displacer cylinder portion 20 of the engine, the engine operates in the opposite direction of rotation.

Figure 8:
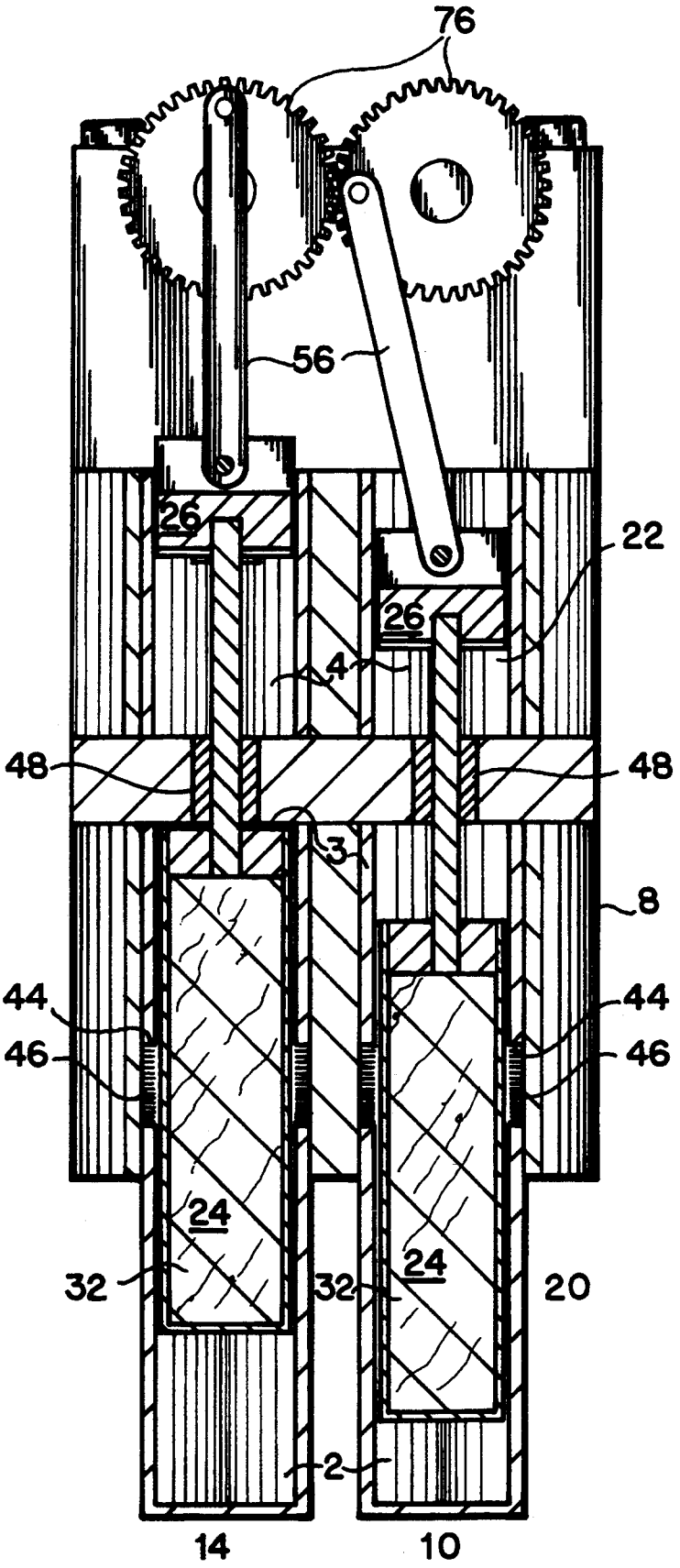
FIG. 8 shows an alternative embodiment of the present invention comprising a circular configuration for a Stirling cycle engine with output of rotational force provided by means of a spur gear drive.

FIG. 8 shows an alternative embodiment of the invention whereby four cylinders 10, 12, 14 and 16 of a Stirling cycle engine are arranged in a square formation, within a circular block 70 thereby providing a physically compact engine.

Referring to FIG. 8, connecting rod 56 of each cylinder 10, 12, 14 and 16 is pivotally connected to a spur gear 76 at the periphery of spur gear 76. Reciprocating motion is thereby converted to a rotational force.

It is specifically noted that the above described apparatus may be operated in the alternative as a heat pump.

While there is shown and described the present preferred embodiment of the invention, it is to be distinctly understood that this invention is not limited thereto but may be variously embodied to practice within the scope of the following claims.

I claim:

1. A Stirling cycle engine comprising:

one or more groups of four cylinders;

means for dividing the cylinders into a displacer cylinder portion and a power cylinder portion, the displacer cylinder portion further including a cylinder having an annular groove in the cold variable volume chamber of the displacer cylinder portion of the cylinder, the annular groove being adapted to function as a heat regenerator;

displacement piston means slidably disposed in the displacer cylinder portion of each cylinder defining a hot variable volume chamber and a cold variable volume chamber;

power piston means slidably disposed in the power cylinder portion of each cylinder defining a compression chamber within each cylinder;

means for connecting the displacer piston means and the power piston means in each cylinder for concurrent reciprocation of the displacement piston and the power piston therein; and means for connecting the cold variable volume chamber in one cylinder to the compression chamber in another cylinder in which the displacer piston means and the power piston means are ninety degrees (90°) out-of-phase in crankshaft rotation to the displacer piston means and the power piston means in the connected cylinder.

2. A Stirling cycle engine according to claim 1 wherein the means for connecting the cold variable volume chamber in one cylinder to the compression chamber in another cylinder in which the displacer piston means and the power piston means are ninety degrees (90°) out-of-phase in rotation in relation to the pistons in the connected cylinder comprises a cylinder cross connect passage.

3. A Stirling cycle engine according to claim 1 wherein the displacement piston means comprises a hollow cylinder having two ends, both ends being closed; and the inside portion of the hollow cylinder being filled with an insulating material.

4. A Stirling cycle engine according to claim 1 wherein the means for connecting the displacer piston means and the power piston means in each cylinder for concurrent reciprocation of the displacer piston means and the power piston means comprises a sealed piston rod having a first end and a second end, the first end being connected to the displacement piston and the second end being connected to the power piston;

5. A Stirling cycle engine according to claim 1 wherein the means for dividing the cylinders into a displacer cylinder portion and a power cylinder portion comprises a bulkhead.

6. A Stirling cycle engine according to claim 1 wherein means are provided for converting reciprocating motion of the power piston means to a rotational output motion.

7. A Stirling cycle engine according to claim 1 wherein the means for dividing the cylinders into a displacer cylinder portion and a power cylinder portion comprises a removable bulkhead means adapted to provide means for cross connecting the cold variable volume chamber in one cylinder to the compression chamber in another cylinder in which the displacer piston means and the power piston means are ninety degrees (90°) out-of-phase in relation to the displacer piston means and the power piston means in the cross connected cylinder.

8. A Stirling cycle engine comprising:

one or more groups of four cylinders;

means for dividing the cylinders into a displacer cylinder portion and a power cylinder portion further comprising means for dividing the cylinders into a displacer cylinder portion and a power cylinder portion including a removable bulkhead means adapted to provide means for cross connecting the cold variable volume chamber in one cylinder to the compression chamber in another cylinder in which the displacer piston means and the power piston means are ninety degrees (90°) out-of-phase in relation to the displacer piston means and the power piston means in the cross connected cylinder, wherein the removable bulkhead means is adapted so that it may be removed, reoriented and reinstalled to allow the engine to operate in an opposite direction of rotation;

displacement piston means slidably disposed in the displacer cylinder portion of each cylinder defining a hot variable volume chamber and a cold variable volume chamber;

power piston means slidably disposed in the power cylinder portion of each cylinder defining a compression chamber within each cylinder;

means for connecting the displacer piston means and the power piston means in each cylinder for concurrent reciprocation of the displacement piston and the power piston therein; and means for connecting the cold variable volume chamber in one cylinder to the compression chamber in another cylinder in which the displacer piston means and the power piston means are ninety degrees (90°) out-of-phase in crankshaft rotation to the displacer piston means and the power piston means in the connected cylinder.

9. A Stirling cycle engine comprising:

one or more groups of four cylinders;

means foe dividing the cylinders into a displacer cylinder portion and a power cylinder portion;

displacement piston means slidably disposed in the displacer cylinder portion of each cylinder defining a hot variable volume chamber and a cold variable volume chamber;

power piston means slidably disposed in the power cylinder portion of each cylinder defining a compression chamber within each cylinder;

means for connecting the displacer piston means and the power piston means in each Cylinder for concurrent reciprocation of the displacement piston and the power piston therein;

means for connecting the cold variable volume chamber in one cylinder to the compression chamber in another cylinder in which the displacer piston means and the power piston means are ninety degrees (90°) out-of-phase in crankshaft rotation to the displacer piston means and the power piston means in the connected cylinder comprising a cylinder cross connect passage, the cylinder cross connect passage further comprising an inlet from the cold variable volume chamber of one cylinder;

valve means;

two outlet passages, a first outlet passage and a second outlet passage, each outlet passage having two ends, a first end and a second end, the first end of the first outlet passage connected to the valve means and the second end of the first outlet passage connected to the compression chamber of which the displacer piston means and the power piston means are ninety degrees (90°) out-of-phase to the displacer piston means and the power piston means in the connected cylinder.

10. A Stirling cycle engine according to claim 3 wherein one or more groups of four cylinders are configured in an in-line configuration.

11. A Stirling cycle engine according to claim 1 wherein one or more groups of four cylinders are configured in a number of rows, the number of rows being divisible by two.

12. A Stirling cycle engine according to claim 1 wherein each of said groups of four cylinders are arranged in a square configuration.

13. A Stirling cycle engine comprising:

one or more groups of four cylinders wherein one or more groups of four cylinders are configured in an in-line configuration;

means for dividing the cylinders into a displacer cylinder portion and a power cylinder portion;

displacement piston means slidably disposed in the displacer cylinder portion of each cylinder defining a hot variable volume chamber and a cold variable volume chamber;

power piston means slidably disposed in the power cylinder portion of each cylinder defining a compression chamber within each cylinder;

means for connecting the displacer piston means and the power piston means in each cylinder for concurrent reciprocation of the displacement piston and the power piston therein;

means for connecting the cold variable volume chamber in one cylinder to the compression chamber in another cylinder in which the displacer piston means and the power piston means are ninety degrees (90°) out-of-phase in crankshaft rotation to the displacer piston means and the power piston means in the connected cylinder;

means for converting the reciprocating motion of the power piston to rotational output motion comprising rocker arms, each rocker arm pivoting about a fixed point at its center and having two ends, a first end and a second end, the first end being pivotally connected to the connecting rod of a piston which is one-hundred and eighty degrees (180°) out-of-phase with the power piston of an adjacent cylinder, pivotally connected by means of a connecting rod to the second end of the rocker arm;

throw arms, a first throw arm and a second throw arm, each throw arm having two ends, a first end and a second end, the first end being pivotally connected to the rocker arm at a point between the fixed point at the center of the rocker arm and one of the two ends of the rocker arm and pivotally connected to a crank bevel gear at the crank bevel gear's periphery, the first throw arm being pivotally connected to the periphery of its crank bevel gear at a point ninety degrees (90°) preceding the second throw arm for rotating said crank bevel gear upon rocking of the rocker arm; and a driveshaft bevel gear forming one end of a driveshaft orthogonally aligned in contact with said crank bevel gear for rotating therewith.

14. A Stirling cycle engine according to claim 6 wherein the means for converting the reciprocating motion of the power piston to a rotational output motion comprises a connecting rod having a first end and a second end, the first end being pivotally connected to the power piston means by a wrist pin assembly and the second end being pivotally connected to the crankshaft arm of a crankshaft.

15. A Stirling cycle engine comprising:

one or more groups of four cylinders;

means for dividing the cylinders into a displacer cylinder portion and a power cylinder portion comprising a removable bulkhead means adapted to provide means for cross connecting the cold variable volume chamber in one cylinder to the compression chamber in another cylinder in which the displacer piston means and the power piston means are ninety degrees (90°) out-of-phase in relation to the displacer piston means and the power piston means in the cross connected cylinder;

displacement piston means slidably disposed in the displacer cylinder portion of each cylinder defining a hot variable volume chamber and a cold variable volume chamber;

power piston means slidably disposed in the power cylinder portion of each cylinder defining a compression chamber within each cylinder;

means for connecting the displacer piston means and the power piston means in each cylinder for concurrent reciprocation of the displacement piston and the power piston therein; and means for connecting the cold variable volume chamber in one cylinder to the compression chamber in another cylinder in which the displacer piston means and the power piston means are ninety degrees (90°) out-of-phase in crankshaft rotation to the displacer piston means and the power piston means in the connected cylinder.

* * * * *